US007942641B2

(12) United States Patent
Bailey et al.

(10) Patent No.: US 7,942,641 B2
(45) Date of Patent: May 17, 2011

(54) VARYING FLUENCE AS A FUNCTION OF THICKNESS DURING LASER SHOCK PEENING

(75) Inventors: Mark Samuel Bailey, Fairfield, OH (US); Michael Paul Hausfeld, Sharonville, OH (US); Donald Eugene Williams, Jr., Loveland, OH (US); Todd Jay Rockstroh, Maineville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/782,305

(22) Filed: May 18, 2010

(65) Prior Publication Data

US 2010/0226780 A1 Sep. 9, 2010

Related U.S. Application Data

(62) Division of application No. 11/540,186, filed on Sep. 29, 2006, now Pat. No. 7,736,450.

(51) Int. Cl.
*F03B 3/12* (2006.01)
*C21D 1/00* (2006.01)

(52) U.S. Cl. ..... 416/241 R; 148/421; 148/565

(58) Field of Classification Search ..... 416/241 R, 416/223 R, 223 A; 72/76; 148/421
See application file for complete search history.

(56) References Cited

U.S. PATENT DOCUMENTS

| | | | |
|---|---|---|---|
| 3,525,575 | A | 8/1970 | Steinack et al. |
| 3,850,698 | A | 11/1974 | Mallozzi et al. |
| 4,401,477 | A | 8/1983 | Clauer et al. |
| 4,937,421 | A | 6/1990 | Ortiz, Jr. et al. |
| 5,131,957 | A | 7/1992 | Epstein et al. |
| 5,492,447 | A | 2/1996 | Mannava et al. |
| 5,531,570 | A | 7/1996 | Mannava et al. |
| 5,591,009 | A | 1/1997 | Mannava et al. |
| 5,674,328 | A | 10/1997 | Mannava et al. |
| 5,674,329 | A | 10/1997 | Mannava et al. |
| 5,756,965 | A | 5/1998 | Mannava |
| 5,911,891 | A | 6/1999 | Dulaney et al. |
| 5,932,120 | A | 8/1999 | Mannava et al. |
| 6,454,535 | B1 | 9/2002 | Goshorn et al. |
| 6,559,415 | B1 | 5/2003 | Mannava et al. |
| 6,570,125 | B2 | 5/2003 | Suh et al. |
| 6,570,126 | B2 | 5/2003 | Suh et al. |
| 6,657,160 | B2 | 12/2003 | Hackel et al. |

(Continued)

FOREIGN PATENT DOCUMENTS

EP 924306 A2 6/1999

(Continued)

OTHER PUBLICATIONS

"Distributed Intelligence Drives High-Energy Laser Manufacturing", Photonics Tech Briefs, Jul. 2006, www.ptbmagazine.com, 2 pages.

(Continued)

*Primary Examiner* — Edward Look
*Assistant Examiner* — Dwayne J White
(74) *Attorney, Agent, or Firm* — William Scott Andes; Steven J. Rosen

(57) ABSTRACT

A method for simultaneously laser shock peening opposite laser shock peening surfaces on opposite sides of an article, such as a gas turbine engine airfoil, with varying thickness using oppositely aimed laser beams and varying surface fluence of the laser beams over the laser shock peening surfaces as a function of the thickness of the article beneath each one of a plurality of laser shock peened spots formed by the beams on the surfaces. The fluence may be equal to the thickness multiplied by a volumetric fluence factor, the volumetric fluence factor being held constant over the laser shock peening surface. The volumetric fluence factor may be in a range of about 1200 J/cm$^3$ to 1800 J/cm$^3$ and more particularly about 1500 J/cm$^3$. Laser beam energy may be varied with a computer program controlling firing of the laser beam.

37 Claims, 7 Drawing Sheets

U.S. PATENT DOCUMENTS

| | | | | |
|---|---|---|---|---|
| 6,752,593 | B2 * | 6/2004 | Clauer et al. | 416/241 R |
| 6,875,953 | B2 | 4/2005 | Clauer et al. | |
| 7,286,580 | B2 | 10/2007 | Dane et al. | |

FOREIGN PATENT DOCUMENTS

| | | | |
|---|---|---|---|
| EP | 933438 | A1 | 8/1999 |
| EP | 1288317 | A1 | 3/2003 |
| EP | 1473373 | A1 | 11/2004 |
| EP | 1577403 | A1 | 9/2005 |

OTHER PUBLICATIONS

"Laser shock peening for fatigue resistance", A.H. Clauer, In: J.K. Gregory, H.J. Rack, and D. Eylon, Editors, Surface performance of titanium, TMS, Warrendale (PA) 1996, pp. 217-230.

EPO 7117100 European Search Report with Annex, Oct. 12, 2009, 6 pages.

* cited by examiner

VARYING FLUENCE AS A FUNCTION OF THICKNESS DURING LASER SHOCK PEENING

CROSS-REFERENCE TO RELATED APPLICATIONS

This application is a divisional of U.S. Utility application Ser. No. 11/540,186, filed on Sep. 29, 2006 now U.S. Pat. No. 7,736,450, entitled "VARYING FLUENCE AS A FUNCTION OF THICKNESS DURING LASER SHOCK PEENING", which is incorporated herein by reference in its entirety.

BACKGROUND OF THE INVENTION

1. Field of the Invention

This invention relates to laser shock peening and, more particularly, to methods and articles of manufacture employing varying surface fluence of a laser beam during laser shock peening.

2. Description of Related Art

Laser shock peening or laser shock processing, as it is also referred to, is a process for producing a region of deep compressive residual stresses imparted by laser shock peening a surface area of an article. Laser shock peening typically uses one or more radiation pulses from high energy, about 50 joules or more, pulsed laser beams to produce an intense shockwave at the surface of an article similar to methods disclosed in U.S. Pat. No. 3,850,698 entitled "Altering Material Properties"; U.S. Pat. No. 4,401,477 entitled "Laser Shock Processing"; and U.S. Pat. No. 5,131,957 entitled "Material Properties". The use of low energy laser beams is disclosed in U.S. Pat. No. 5,932,120, entitled "Laser Shock Peening Using Low Energy Laser", which issued Aug. 3, 1999 and is assigned to the present Assignee of this patent. Laser shock peening, as understood in the art and as used herein, means utilizing a pulsed laser beam from a laser beam source to produce a strong localized compressive force on a portion of a surface by producing an explosive force at the impingement point of the laser beam by an instantaneous ablation or vaporization of a thin layer of that surface or of a coating (such as tape or paint) on that surface which forms a plasma.

Laser shock peening is being developed for many applications in the gas turbine engine field, some of which are disclosed in the following U.S. Pat. No.: 5,756,965 entitled "On The Fly Laser Shock Peening"; U.S. Pat. No. 5,591,009 entitled "Laser Shock Peened Gas Turbine Engine Fan Blade Edges"; U.S. Pat. No. 5,531,570 entitled "Distortion Control For Laser Shock Peened Gas Turbine Engine Compressor Blade Edges"; U.S. Pat. No. 5,492,447 entitled "Laser Shock Peened Rotor Components For Turbomachinery"; U.S. Pat. No. 5,674,329 entitled "Adhesive Tape Covered Laser Shock Peening"; and U.S. Pat. No. 5,674,328 entitled "Dry Tape Covered Laser Shock Peening", all of which are assigned to the present Assignee.

Laser shock peening has been utilized to create a compressively stressed protective layer at the outer surface of an article which is known to considerably increase the resistance of the article to fatigue failure as disclosed in U.S. Pat. No. 4,937,421 entitled "Laser Peening System and Method". These methods typically employ a curtain of water flowed over the article or some other method to provide a plasma confining medium. This medium enables the plasma to rapidly achieve shockwave pressures that produce the plastic deformation and associated residual stress patterns that constitute the LSP effect. The curtain of water provides a confining medium, to confine and redirect the process generated shockwaves into the bulk of the material of a component being LSP'd, to create the beneficial compressive residual stresses.

The pressure pulse from the rapidly expanding plasma imparts a traveling shockwave into the component. This compressive shockwave initiated by the laser pulse results in deep plastic compressive strains in the component. These plastic strains produce residual stresses consistent with the dynamic modules of the material. The many useful benefits of laser shock peened residual compressive stresses in engineered components have been well documented and patented, including the improvement on fatigue capability.

The laser shock process (LSP) imparts deep compressive stresses in the article by generating a pressure pulse that travels into the component. The pressure pulse can be reflected from internal structures as tensile waves. Opposing waves and single waves can have sufficient energy in this reflected wave to rupture the component internally. The resulting crack or rupture is referred to or termed "delamination". One method proposed in the past to avoid or minimize delaminations is offsetting two opposing laser beams/waves laterally through the component. See U.S. Pat. No. 6,570,126 entitled "Simultaneous Offset Dual Sided Laser Shock Peening Using Low Energy Laser Beams" and U.S. Pat. No. 6,570,125 entitled "Simultaneous Offset Dual Sided Laser Shock Peening With Oblique Angle Laser Beams". Alternatively, striking the component or part from one side at a time has been suggested.

Both of these methods seem to reduce compressive LSP effect but appear limited in their ability to efficiently process small, thin components or articles such as gas turbine engine airfoils. This applies to stator vane and rotor blade airfoils for fans, compressors and turbines in the engine. The fact that a delamination can occur and is hidden within the component, requires 100% inspection of each part or article that is laser shock peened using techniques such as full immersion ultrasonic inspection which can greatly add to the cost of the component over an above the cost of the LSP process.

It is desirable to reduce the level or eliminate delamination due to laser shock peening particularly in thin part sections.

SUMMARY OF THE INVENTION

A variable surface fluence laser shock peening method for laser shock peening an article includes simultaneously laser shock peening opposite laser shock peening surfaces on opposite sides respectively of an article with varying thickness using oppositely aimed laser beams and varying surface pulse fluence of the laser beams over the laser shock peening surfaces as a function of the thickness of the article beneath each one of a plurality of laser shock peened spots formed by the beams on the surfaces. In an exemplary embodiment of the method, the pulse fluence is kept equal to the thickness multiplied by a volumetric fluence factor and the volumetric fluence factor is held constant over the laser shock peening surfaces. The volumetric fluence factor may be in a range of about 1200 J/cm$^3$ to 1800 J/cm$^3$ and one particular value of the volumetric fluence factor is about 1500 J/cm$^3$.

One exemplary embodiment of the varying of surface pulse fluence over the laser shock peening surfaces includes varying the surface pulse fluence individually for each of the laser shock peened spots such as by varying laser beam energy of the laser beams individually for each of the laser shock peened spots. A computer program to control firing of the laser beam or to control a device external to a laser performing the firing may be used for changing the laser beam energy in the laser beam. Another exemplary embodiment of the varying of surface pulse fluence over the laser shock peening surfaces includes varying the surface pulse fluence incrementally for groups of the laser shock peened spots.

In one particular application of the method, the article is a gas turbine engine airfoil and, in a more particular application, the article is a thin gas turbine engine rotor blade airfoil such as a thin gas turbine engine compressor blade airfoil made of a Titanium alloy having a maximum thickness of about 0.1 inches.

DETAILED DESCRIPTION OF THE INVENTION

Figure 1:
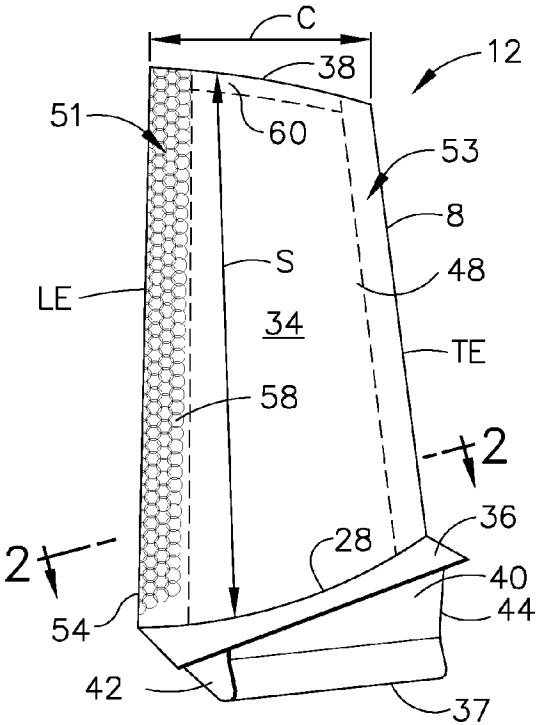
FIG. 1 is a perspective view illustration of a gas turbine engine blade with airfoil exemplifying an article laser shock peened using a variable surface pulse fluence laser shock peening method.
Figure 2:
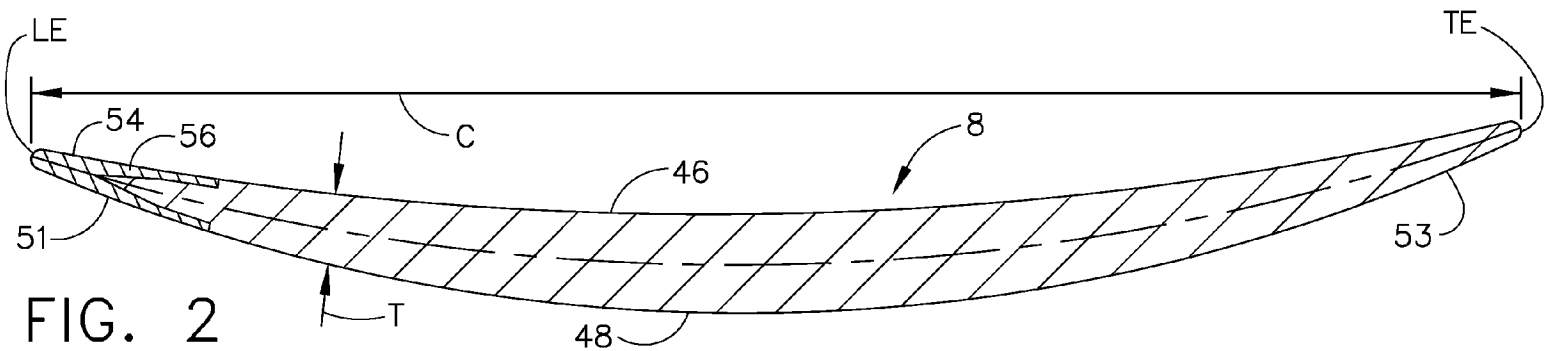
FIG. 2 is a cross-sectional view illustration of the laser shock peened areas at a leading edge of the airfoil of the blade illustrated in FIG. 1.

Illustrated in FIGS. 1 and 2 is a compressor blade 8 having an airfoil 34 extending radially outwardly from a blade platform 36 from an airfoil base 28 to a airfoil tip 38. The compressor blade 8 and its airfoil 34 may be made from a Titanium alloy. Nickel alloys such as Inconel or more particularly Inconel 718 may also be used. The blade 8 is representative of a hard metallic article 12 with varying thickness T (along the leading and trailing edges LE and TE and the airfoil tip 38). Laser shock peening articles is well known. The blade 8 includes a root section 40 extending radially inward from the platform 36 to a radially inward end 37 of the root section 40. At the radially inward end 37 of the root section 40 is a blade root 42 which is connected to the platform 36 by a blade shank 44. The airfoil 34 extends in the chordwise direction between a leading edge LE and a trailing edge TE of the airfoil. A span S of the airfoil 34 is defined as the distance between the airfoil base 28 and the airfoil tip 38. A chord C of the airfoil 34 is the line between the leading LE and trailing edge TE at each cross-section of the blade. A pressure side 46 of the airfoil 34 faces in the general direction of rotation as indicated by an arrow V and a suction side 48 is on the other side of the airfoil 34.

It is well known to use laser shock peening to counter possible fatigue failure of portions of an article. The airfoil 34, for instance, is subject to a significant tensile stress field due to centrifugal forces generated by the blade 8 rotating during engine operation. The airfoil 34 is also subject to vibrations generated during engine operation and nicks 52 and tears operate as high cycle fatigue stress risers producing additional stress concentrations around them. Typically, laser shock peening surfaces 54 on one or both sides of the article such as the blade 8 are laser shock peened producing laser shock peened patches or laser shock peening surfaces 54 and pre-stressed regions 56 having deep compressive residual stresses imparted by a laser shock peening (LSP) method extending into the article from the laser shock peened surfaces 55.

Figure 3:
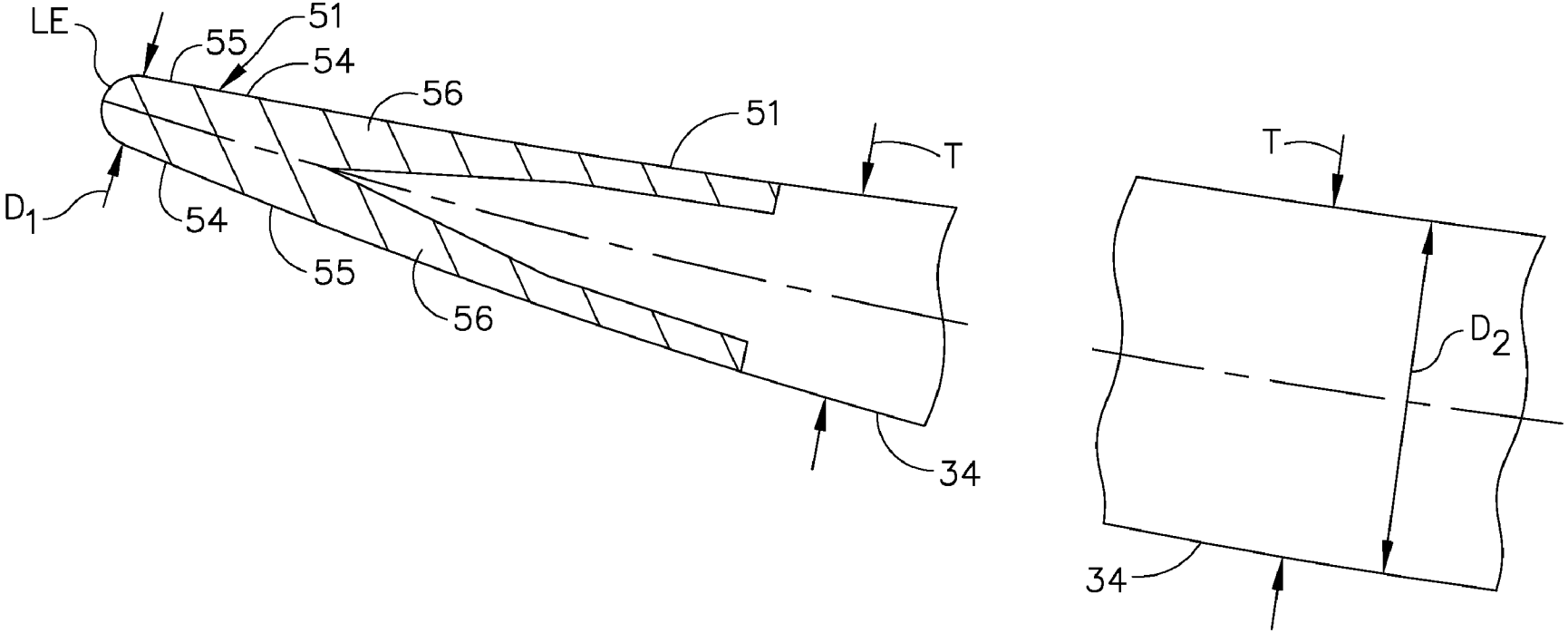
FIG. 3 is an enlarged cross-sectional view illustration of the leading edge illustrated in FIG. 2.

The laser shock peened surfaces 55 may extend all the way along the leading edge LE from the airfoil base 28 to the airfoil tip 38 and may also be along the trailing edge TE or along the airfoil tip 38. The laser shock peened surfaces 55 may also extend over the entire airfoil 34 on the pressure and suction sides 46 and 48, respectively. The leading edge LE, the trailing edge TE, and the airfoil tip 38 are all sections of the airfoil that may be very thin and subject to delamination due to the laser shock peening. Thin gas turbine engine airfoils for which laser shock peening may be used includes those found in stator vanes and rotor blades of fans, compressors and turbines in the engine. These are examples of thin articles or articles having thin sections which may be laser shock peened and be subject to delamination due to laser shock peening. FIG. 3 illustrates an exemplary leading edge section 51 of a compressor blade airfoil having a maximum thickness of about 0.1 inches and laser shock peened sections having a local thickness T starting at about 0.02 inches along the leading and trailing edges and airfoil tip of the airfoils. Compressive pre-stressed regions 56 due to laser shock peening generally extend into the airfoil 34 from laser shock peened surfaces 55.

In order to avoid or reduce delamination, a variable surface pulse fluence laser shock peening method for laser shock peening a thin article with varying thickness T was developed which varies a surface pulse fluence f of individual pulses or individual spots of a pulsed laser beam 2 over the laser shock peening surface 54 as a function F of the thickness T of the article beneath an individual laser shock peened spot 58 formed by a single pulse of the pulsed laser beam 2 on the laser shock peening surface 54. There are many ways to vary the surface pulse fluence f of the laser beam 2. The strength of the beam 2 may be increased or decreased and the laser shock peened spot 58, the area the laser beam forms on the laser shock peening surface 54, is held fixed. Alternatively, the area of the laser shock peened spot 58 may be increased or decreased and the strength of the laser beam 2 is held fixed or constant.

An example of an article with varying thickness is a compressor blade airfoil as illustrated in FIGS. 1 and 2 as described above. The laser shock peening method presented herein can also be used on airfoils of other rotor blades such as fan and turbine blades and on as stator vanes in fan, compressor, and turbine sections of a gas turbine engine. Other types of articles not related to gas turbine engines or parts and having thin sections may also be laser shock peened using the method presented herein.

The airfoil is thinnest at the leading and trailing edges LE and TE and gradually becomes thicker in leading and trailing edge sections 51 and 53 away from the leading and trailing edges LE and TE as illustrated by the varying thickness T in FIGS. 2 and 3. An exemplary leading edge diameter D1 is about 0.02 inches and an exemplary maximum diameter D2 of the airfoil 34 is about 0.1 inches. Eventually, the airfoil 34 becomes a nearly flat plate (semi-parallel pressure and suction sides 46 and 48) going away from the leading and trailing edges LE and TE to a point where there is no benefit to additional increases in the local fluence (LSP effect is saturated). The same is true in an airfoil tip section 60 of the airfoil 34 since the tip of an airfoil typically has a thinner cross section than the root portion of a given airfoil.

Figure 4:
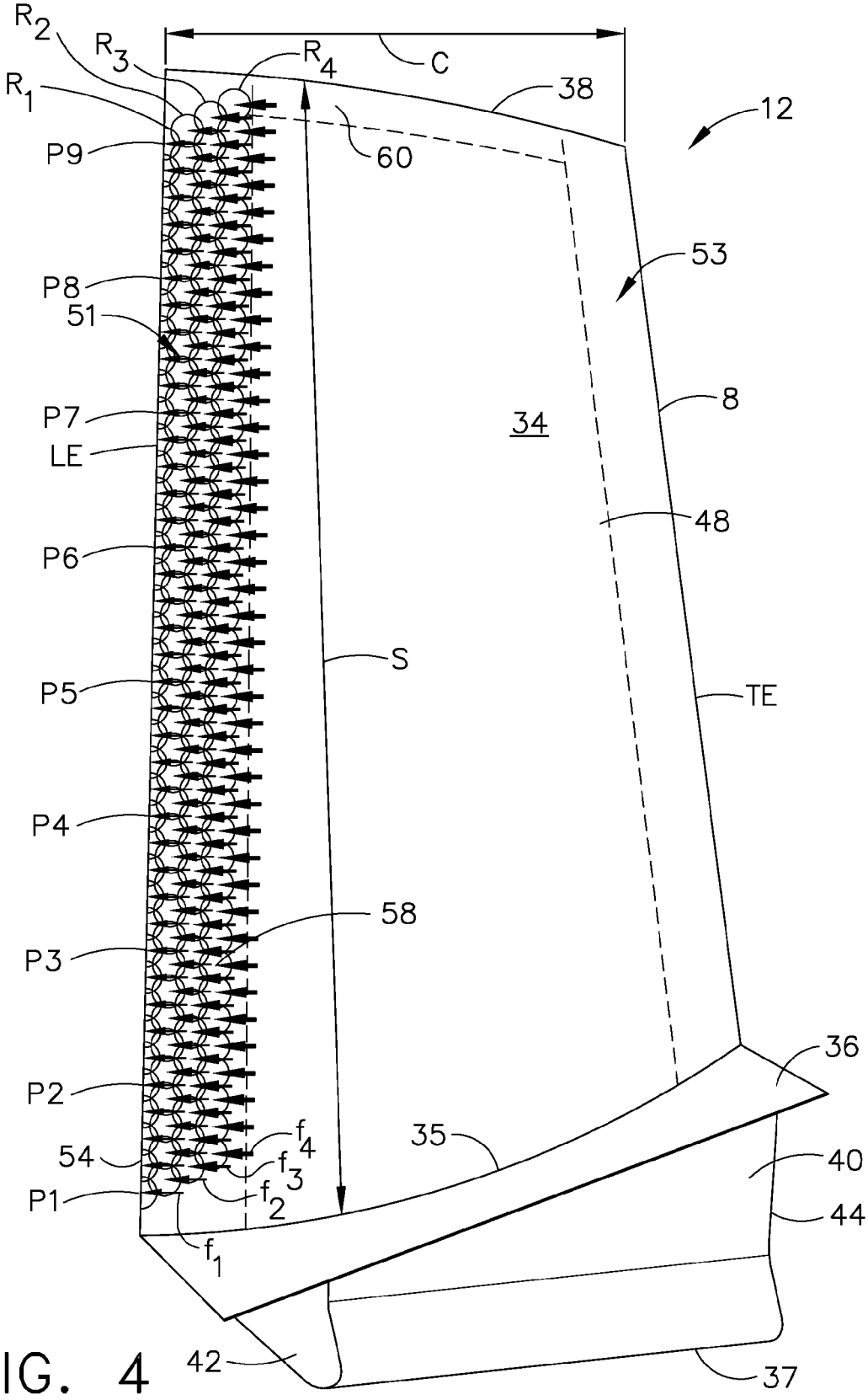
FIG. 4 is a schematic illustration of using a first exemplary variable surface pulse fluence laser shock peening method to laser shock peen the article illustrated in FIG. 1.

The method provides lower surface pulse fluence or laser energy at the leading edge which is the thinnest portion of the airfoil and higher surface pulse fluences or laser energies aft of the leading edge. The exemplary method illustrated herein employs a change in the energy of the laser beam 2 to produce changes in the surface pulse fluence in the laser shock peening process. Illustrated schematically in FIG. 4 is the varying surface pulse fluences used to LSP the leading edge section 51 of the airfoil 34. The thickness T of the leading edge section 51 is very thin at the leading edge and gets thicker going away from the leading edge towards the trailing edge. Four rows of laser shock peened circular spots 58 are illustrated. The exemplary method illustrated herein keeps the fluence f equal to the thickness T multiplied by a volumetric fluence factor VF and keeps the volumetric fluence factor constant over the laser shock peening surface 54. An exemplary range of the volumetric fluence factor VF is about 1200 J/cm$^3$ to 1800 J/cm$^3$. An exemplary embodiment of the volumetric fluence factor is about 1500 J/cm$^3$. The surface pulse fluence may be adjusted for each point that is laser shock peened.

The airfoil 34 illustrated in FIG. 4 indicates laser shock peened spot 58 in first, second, third, and fourth row R1, R2, R3, and R4 respectively. Each spot can be laser shock peened with an amount of laser energy such that the surface pulse fluence is about constant in the laser shock peened surface 55 (LSP surface) of the leading edge section 51. Chart 1 below illustrates the thickness of the airfoil of first through ninth positions P1-P9 respectively in each of the four rows in the laser shock peened leading edge section 51. More than the first through ninth positions P1-P9 are laser shock peened as indicated in FIG. 4 and these nine positions are used in the charts to illustrate the method. FIG. 4 illustrates incremental changes in the surface pulse fluences used. The thickness variation within each of the row 1 though 4 is no greater than 10% and, thus, each of the positions within a row is laser shock peened using the same surface pulse fluence and, because they all have the same size circular laser shock peened spot 58, with the same laser energy. The first through fourth rows 1-4 respectively represent groups that are laser shock peened with first through fourth surface incremental fluences f1 through f4 respectively as indicated by the arrows so labeled in FIG. 4.

CHART 1

| Exemplary Thickness for LSP surface (in) | | | | |
|---|---|---|---|---|
| Position | Row 1 | Row 2 | Row 3 | Row 4 |
| P1 | 0.011 | 0.016 | 0.019 | 0.022 |
| P2 | 0.011 | 0.016 | 0.019 | 0.021 |
| P3 | 0.011 | 0.016 | 0.019 | 0.021 |
| P4 | 0.011 | 0.016 | 0.019 | 0.021 |
| P5 | 0.010 | 0.016 | 0.019 | 0.021 |
| P6 | 0.010 | 0.015 | 0.019 | 0.021 |
| P7 | 0.010 | 0.015 | 0.018 | 0.020 |
| P8 | 0.010 | 0.015 | 0.018 | 0.020 |
| P9 | 0.010 | 0.015 | 0.018 | 0.020 |

The exemplary incremental varying of the surface pulse fluences illustrated in FIG. 4 includes laser shock peening the first and second rows R1 and R2 with first and second surface pulse fluences f1 and f2 respectively. The second surface pulse fluence f2 is greater than the first surface pulse fluence f1 because the thickness T of the leading edge section 51 is greater at the second row than at the first row of laser shock peened circular spots 58. Third and fourth rows R3 and R4 are laser shock peened with a third surface pulse fluence f3 which is greater than the second surface pulse fluence f2 because the thickness T of the leading edge section is greater at the third and fourth rows R3 and R4 than at the second row R2 of laser shock peened circular spots 58. Thus, rows R1 and R2 are laser shock peened as two groups with the first and second surface pulse fluences f1 and f2 and rows R3 and are R4 are laser shock peened together as a third group with the third surface pulse fluence f3.

Chart 2 below illustrates individually adjusted or varied laser energies, as opposed to incrementally adjusted or varied laser energies, that could be used to laser shock peen at the first through ninth positions P1-P9 respectively in each of the four rows in the laser shock peened leading edge section 51. Individually adjusted or varied surface pulse fluences or laser energies more closely maintains the volumetric fluence factor at about 1500 J/cm$^3$ in the laser shock peened leading edge section 51. More than the first through ninth positions P1-P9 are laser shock peened as indicated in FIG. 4 and these nine positions are used in the charts to illustrate the method.

CHART 2

| Local laser Energy, based on fixed spot diameter and constant Volumetric Fluence (1500 J/cm$^3$) Energy (J) | | | | |
|---|---|---|---|---|
| Position | Row 1 | Row 2 | Row 3 | Row 4 |
| 1 | 1.052 | 1.5781 | 1.8937 | 2.1041 |
| 2 | 1.0416 | 1.5624 | 1.875 | 2.0832 |
| 3 | 1.0313 | 1.547 | 1.8564 | 2.0626 |
| 4 | 1.021 | 1.5317 | 1.838 | 2.0422 |
| 5 | 1.011 | 1.5165 | 1.82 | 2.022 |
| 6 | 1.001 | 1.5015 | 1.8018 | 2.002 |
| 7 | 0.9911 | 1.4866 | 1.7839 | 1.9822 |
| 8 | 0.9813 | 1.4719 | 1.7663 | 1.9625 |
| 9 | 0.9716 | 1.4573 | 0.7488 | 1.9431 |

Figure 5:
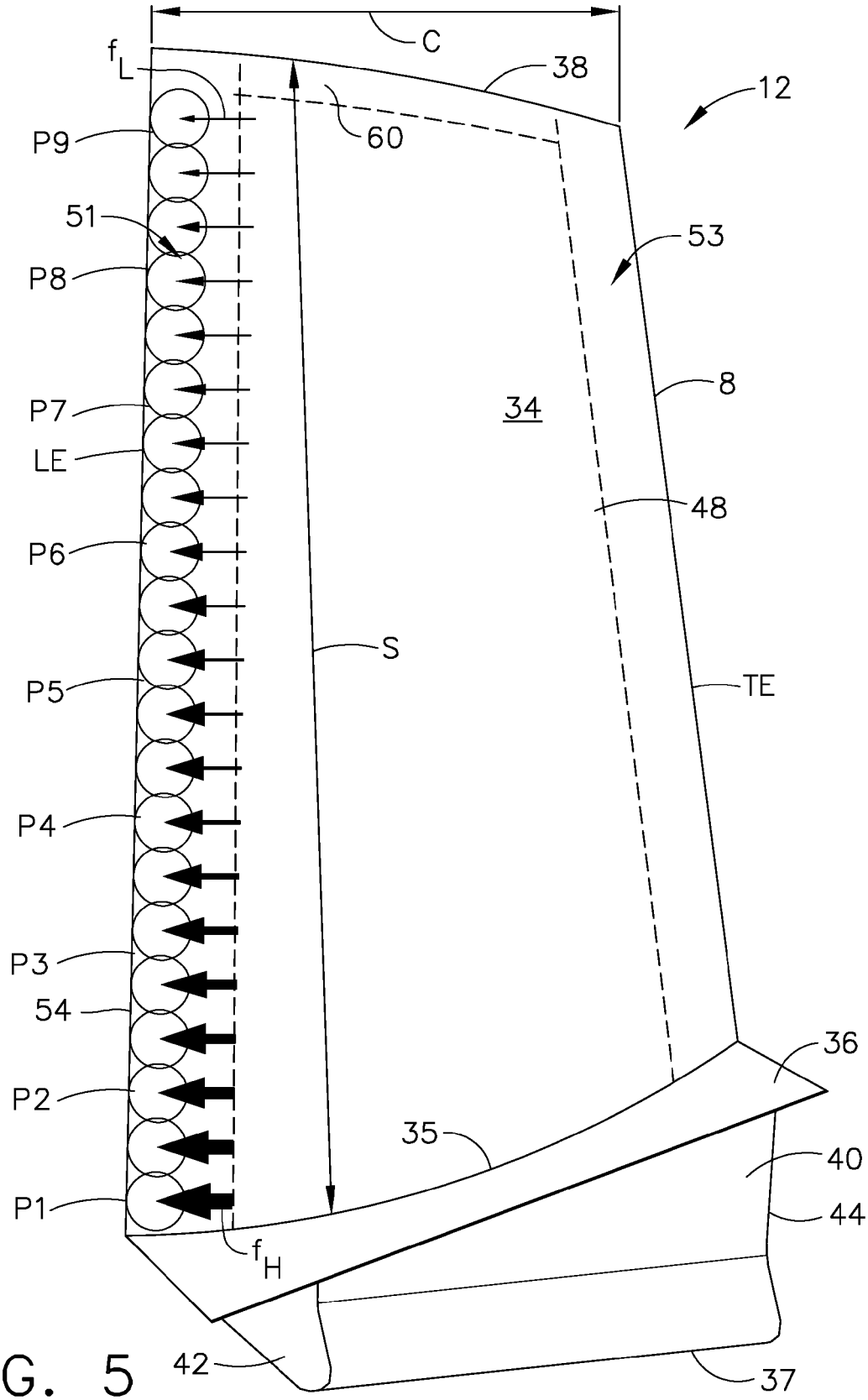
FIG. 5 is a schematic illustration of using a second exemplary variable surface pulse fluence laser shock peening method to laser shock peen the article illustrated in FIG. 1.

The laser energies in Chart 2 are exemplary values and illustrate a range of individually adjusted or varied laser energies required to maintain a constant Volumetric Fluence (1500 J/cm$^3$). A more detailed illustration of the individually varied laser energies is illustrated for the airfoil 34 in FIG. 5. The laser energies or surface pulse fluences illustrated in FIG. 5 range from a highest surface pulse fluence fH at the airfoil base 28 to a lowest surface pulse fluence fL at the airfoil tip 38.

Figure 6:
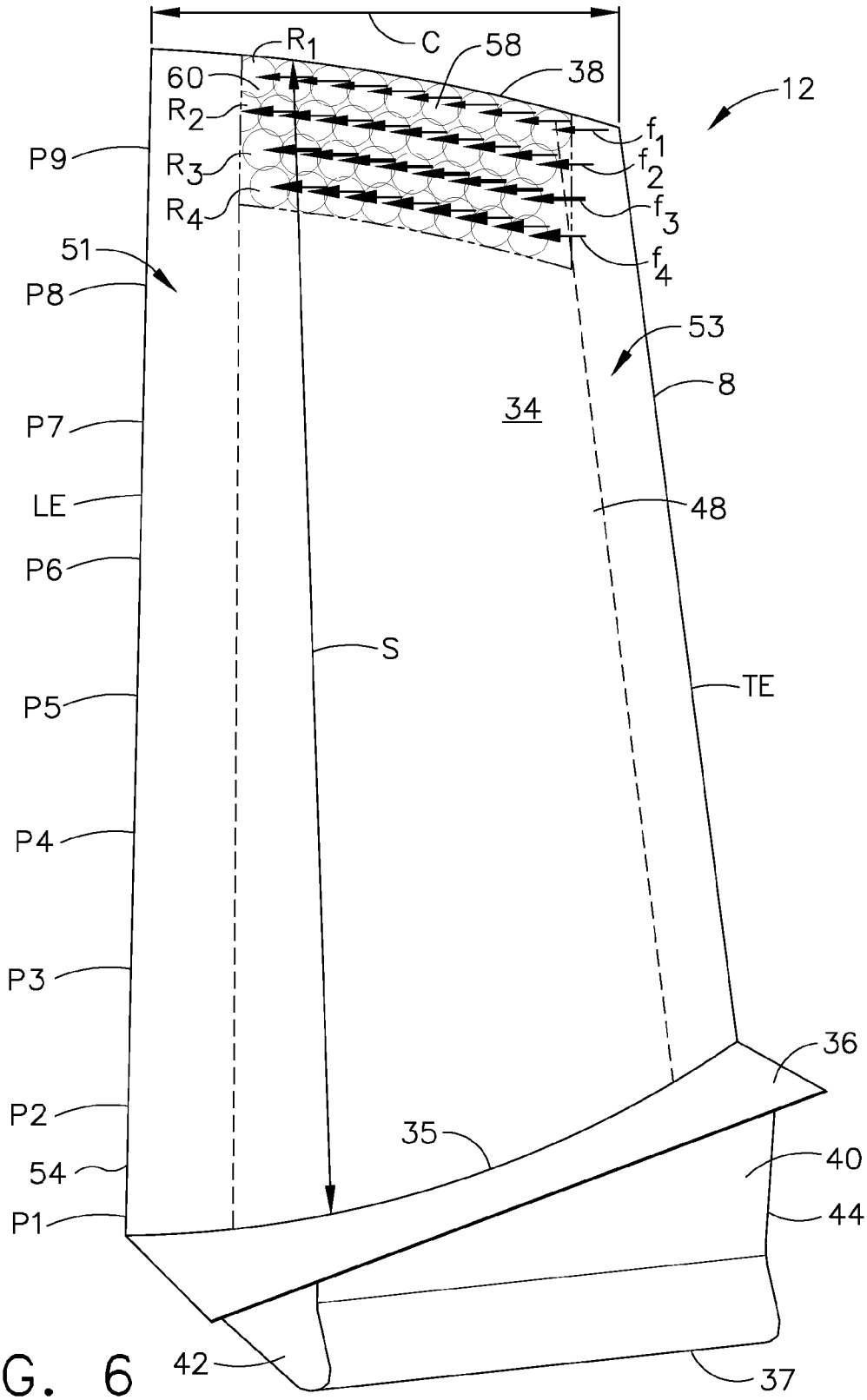
FIG. 6 is a schematic illustration of using the first exemplary variable surface pulse fluence laser shock peening method to laser shock peen a airfoil tip section illustrated in FIG. 1.

FIG. 6 illustrates a variable surface pulse fluence laser shock peening method for the airfoil tip section 60 of the airfoil 34. The exemplary method illustrated in FIG. 6 is incremental varying of the surface pulse fluences which includes laser shock peening the first and second rows R1 and R2 with first and second surface pulse fluences f1 and f2 respectively. The second surface pulse fluence f2 is greater than the first surface pulse fluence f1 because the thickness T of the airfoil tip section 60 is greater at the second row than at the first row of laser shock peened circular spots 58. Third and fourth rows R3 and R4 are laser shock peened with a third surface pulse fluence f3 which is greater than the second surface pulse fluence f2 because the thickness T of the airfoil tip section 60 is greater at the third and fourth rows R3 and R4 than at the second row R2 of laser shock peened circular spots 58.

Figure 7:
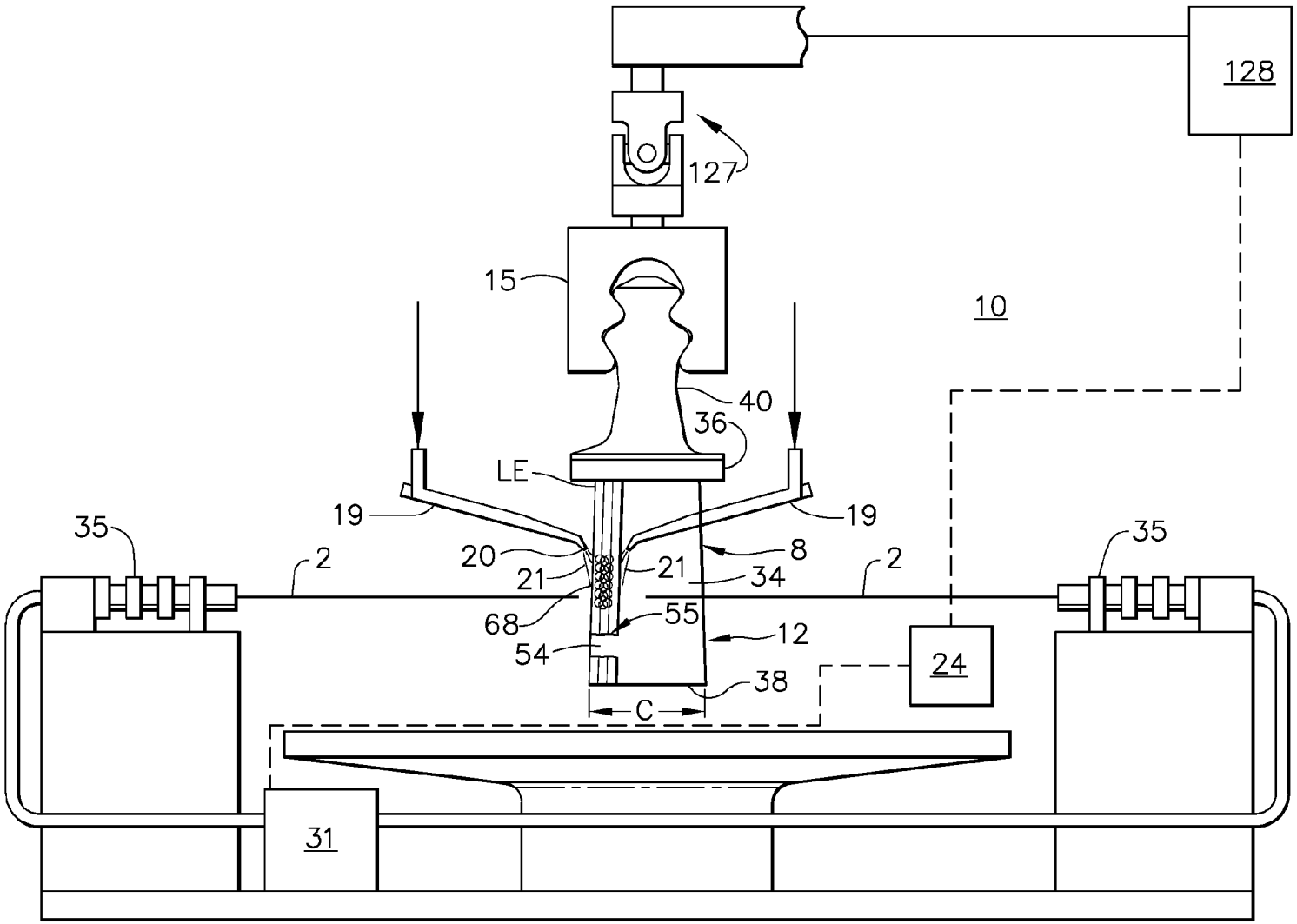
FIG. 7 is a schematic perspective view illustration of a blade, similar to the blade in FIG. 1, mounted in an exemplary laser shock peening system used for variable surface pulse fluence laser shock peening.
Figure 8:
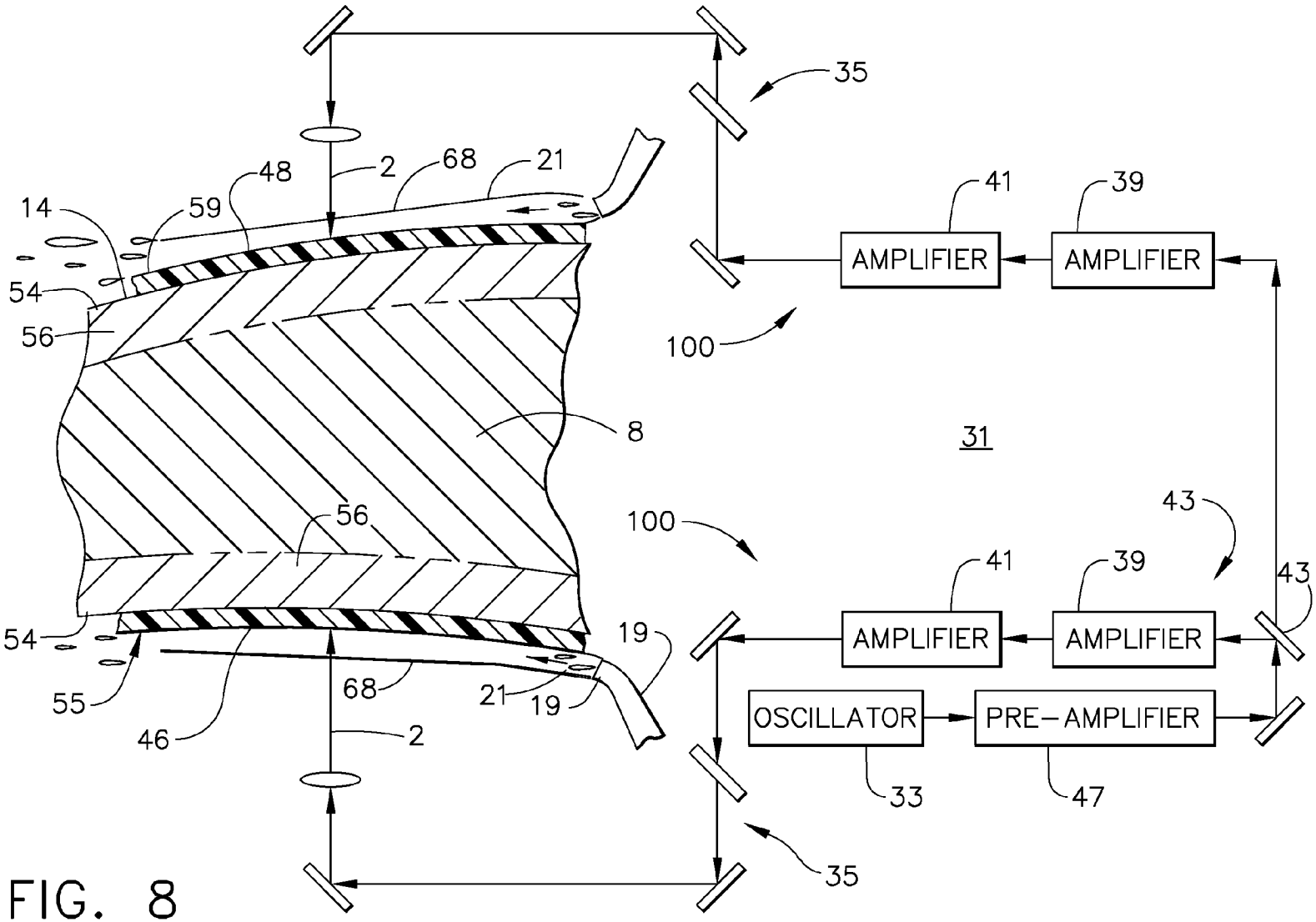
FIG. 8 is a partial cross-sectional and a partial schematic view of the setup in FIG. 7.

Illustrated in FIGS. 7 and 8 is a schematic illustration of a laser shock peening system 10 that is used to laser shock peen articles exemplified by the gas turbine engine rotor blade 8 and the airfoil 34 with the laser shock peening surface 54 that is to be laser shock peened. The laser shock peening system 10 includes a generator 31 having an oscillator and a pre-amplifier and a beam splitter which feeds the pre-amplified laser beam into two beam optical transmission circuits and optics 35 that transmit and focus oppositely aimed laser beams 2 simultaneously on the pressure and suction sides 46 and 48. The blade 8 is mounted in a fixture 15 which is attached to a five-axis computer numerically controlled (CNC) manipulator 127 which is controlled by a CNC controller 128. The manipulator 127 and the CNC controller 128 are used to continuously move and position the blade to provide laser shock peening "on the fly". Robots may also be used. Laser shock peening may be done in a number of various ways using paint or tape as an ablative medium (see in particular U.S. Pat. No. 5,674,329 entitled "Adhesive Tape Covered Laser Shock Peening").

The laser energies in Chart 2 are exemplary values and illustrate a range of individually adjusted or varied laser energies required to maintain a constant Volumetric Fluence (1500 J/cm$^3$). A more detailed illustration of the individually varied laser energies is illustrated for the airfoil 34 in FIG. 5. The laser energies or surface fluences illustrated in FIG. 5 range from a highest surface fluence fH at the airfoil base 28 to a lowest surface fluence fL at the airfoil tip 38.

A clear confining medium 68 to cover the laser shock peening surface 54 is provided by a curtain of clear fluid such as water 21 supplied by a water nozzle 20 at the end of a water supply tube 19. The curtain of flowing water 21 is particular to the exemplary embodiment illustrated herein, however, other types of confining mediums may be used. The laser shock peening system 10 illustrated herein includes a laser beam apparatus including a generator 31 having an oscillator 33 and a pre-amplifier 47 and a beam splitter 43 which feeds the pre-amplified laser beam into two beam optical transmission circuits 100 each having a first and second amplifier 39 and 41, respectively, and optics 35 which include optical elements that transmit and focus the laser beam 2 on the laser shock peening surface 54. A laser controller 24 is used to modulate and fire the laser beam apparatus to fire the laser beam 2 on the bare laser shock peening surface 54 in a controlled manner. The CNC controller 128 usually is used to control the operation of the laser controller 24 particularly as to when to fire the laser beams 2.

The laser beam shock induced deep compressive residual stresses in the compressive pre-stressed regions 56 are generally about 50-150 KPSI (Kilo Pounds per Square Inch) and extend to a depth of about 20-50 mils into the airfoil 34. The laser beam shock induced deep compressive residual stresses are produced by repetitively firing a high energy laser beam 2 that is defocused±a few mils with respect to the laser shock peening surface 54. The laser beam 2 typically has a peak power density on the order of magnitude of a gigawatt/cm$^2$ and is fired with a curtain of flowing water 21 or other fluid that is flowed over the laser shock peening surface 54 or some other clear confining medium. The laser shock peened surfaces 55 may be bare or as illustrated herein may be coated with an ablative coating 59 such as paint or adhesive tape to form coated surfaces as disclosed in U.S. Pat. Nos. 5,674,329 and 5,674,328. The coating 59 provides an ablative medium over which the clear containment medium is placed, such as a fluid curtain such as a curtain of flowing water 21. During laser shock peening, the blade 8 is moved while the stationary laser beams 2 are fired through curtains of flowing water 21, dispensed by water nozzles 20, on the laser shock peened surfaces 55. The laser shock peening process is typically used to form overlapping laser shock peened circular spots 58 on laser shock peened surfaces 55.

The coating or bare metal surface 14 is ablated generating plasma which results in shock waves on the surface of the material. These shock waves are redirected towards the laser shock peening surface 54 by the clear liquid confining medium 68, illustrated herein as the curtain of flowing water 21, or confining layer to generate travelling shock waves (pressure waves) in the material below the laser shock peening surface 54. The amplitude and quantity of these shock-wave determine the depth and intensity of compressive stresses. The shockwaves and the laser beam shock induced deep compressive residual stresses may cause delamination in the thin leading and trailing edge regions 51 and 53. The exemplary variable surface pulse fluence laser shock peening method illustrated herein simultaneously laser shock peens opposite sides of the article illustrated by the pressure and suction sides 46 and 48. This method is also referred to as dual sided laser shock peening. Other embodiments of the variable surface pulse fluence laser shock peening method can be used to laser shock peen just one side of an airfoil or other part or article.

In order to reduce or prevent the delamination, the airfoil 34 which generally represents an article with a varying thickness T is laser shock peened along the laser shock peening surface 54 using a laser beam 2. The exemplary embodiment of the variable surface pulse fluence laser shock peening method, illustrated in FIGS. 7 and 8 varies a surface pulse fluence f of the laser beam 2 over the laser shock peening surface 54 as a function F of a local thickness T of the article beneath a laser shock peened spot 58 formed by the beam on the laser shock peening surface 54. Varying the surface pulse fluence f of the laser beam 2 may be done manually or by automation with the CNC controller 128 using a part program. Thicknesses of the article may be evaluated during the laser shock peening process or stored in the part program.

The exemplary embodiment of the variable surface pulse fluence laser shock peening method illustrated herein uses the CNC controller 128 to send instructions to the laser controller 24 to modulate the energy of the laser beams 2 to vary the surface pulse fluence. The surface pulse fluence f is equal to the thickness T multiplied by a volumetric fluence factor VF and the volumetric fluence factor is held constant over the laser shock peening surface 54. The volumetric fluence factor VF is in a range of about 1200 J/cm$^3$ to about 1800 J/cm$^3$ and a particularly useful value of the volumetric fluence factor is about 1500 J/cm$^3$ for thin gas turbine airfoils made of a Titanium alloy. A device external to the laser generating apparatus described above may also be used to change the energy of the laser beam 2. One such device is an optical attenuator.

A clear confining medium 68 to cover the laser shock peening surface 54 is provided by a curtain of clear fluid such as water 21 supplied by a water nozzle 20 at the end of a water supply tube 19. The curtain of flowing water 21 is particular to the exemplary embodiment illustrated herein, however, other types of confining mediums may be used. The laser shock peening system 10 illustrated herein includes a laser beam apparatus including a generator 31 having an oscillator 33 and a pre-amplifier 47 and a beam splitter 43 which feeds the pre-amplified laser beam into two beam optical transmission circuits 100 each having a first and second amplifier 39 and 41, respectively, and optics 35 which include optical elements that transmit and focus the laser beam 2 on the laser shock peening surface 54. A laser controller 24 is used to modulate and fire the laser beam apparatus to fire the laser beam 2 on the bare laser shock peening surface 54 in a controlled manner. The CNC controller 128 usually is used to control the operation of the laser controller 24 particularly as to when to fire the laser beams 2.

The laser beam shock induced deep compressive residual stresses in the compressive pre-stressed regions 56 are generally about 50-150 KPSI (Kilo Pounds per Square Inch) and extend to a depth of about 20-50 mils into the airfoil 34. The laser beam shock induced deep compressive residual stresses are produced by repetitively firing a high energy laser beam 2 that is defocused±a few mils with respect to the laser shock peening surface 54. The laser beam 2 typically has a peak power density on the order of magnitude of a gigawatt/cm$^2$ and is fired with a curtain of flowing water 21 or other fluid that is flowed over the laser shock peening surface 54 or some other clear confining medium. The laser shock peened surfaces 55 may be bare or as illustrated herein may be coated with an ablative coating 59 such as paint or adhesive tape to form coated surfaces as disclosed in U.S. Pat. Nos. 5,674,329 and 5,674,328. The coating 59 provides an ablative medium over which the clear containment medium is placed, such as a fluid curtain such as a curtain of flowing water 21. During laser shock peening, the blade 8 is moved while the stationary laser beams 2 are fired through curtains of flowing water 21, dispensed by water nozzles 20, on the laser shock peened surfaces 55. The laser shock peening process is typically used to form overlapping laser shock peened circular spots 58 on laser shock peened surfaces 55.

The coating or bare metal surface 14 is ablated generating plasma which results in shock waves on the surface of the material. These shock waves are redirected towards the laser shock peening surface 54 by the clear liquid confining medium 68, illustrated herein as the curtain of flowing water 21, or confining layer to generate travelling shock waves (pressure waves) in the material below the laser shock peening surface 54. The amplitude and quantity of these shockwave determine the depth and intensity of compressive stresses. The shockwaves and the laser beam shock induced deep compressive residual stresses may cause delamination in the thin leading and trailing edge regions 51 and 53. The exemplary variable surface fluence laser shock peening method illustrated herein simultaneously laser shock peens opposite sides of the article illustrated by the pressure and suction sides 46 and 48. This method is also referred to as dual sided laser shock peening. Other embodiments of the variable surface fluence laser shock peening method can be used to laser shock peen just one side of an airfoil or other part or article.

In order to reduce or prevent the delamination, the airfoil 34 which generally represents an article with a varying thickness T is laser shock peened along the laser shock peening surface 54 using a laser beam 2. The exemplary embodiment of the variable surface fluence laser shock peening method, illustrated in FIGS. 7 and 8 varies a surface fluence f of the laser beam 2 over the laser shock peening surface 54 as a function F of a local thickness T of the article beneath a laser shock peened spot 58 formed by the beam on the laser shock peening surface 54. Varying the surface fluence f of the laser beam 2 may be done manually or by automation with the CNC controller 128 using a part program. Thicknesses of the article may be evaluated during the laser shock peening process or stored in the part program.

The exemplary embodiment of the variable surface fluence laser shock peening method illustrated herein uses the CNC controller 128 to send instructions to the laser controller 24 to modulate the energy of the laser beams 2 to vary the surface fluence. The surface fluence f is equal to the thickness T multiplied by a volumetric fluence factor VF and the volumetric fluence factor is held constant over the laser shock peening surface 54. The volumetric fluence factor VF is in a range of about 1200 J/cm$^3$ to about 1800 J/cm$^3$ and a particularly useful value of the volumetric fluence factor is about 1500 J/cm$^3$ for thin gas turbine airfoils made of a Titanium alloy. A device external to the laser generating apparatus described above may also be used to change the energy of the laser beam 2. One such device is an optical attenuator.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method for laser shock peening an article, the method comprising:

simultaneously laser shock peening opposite laser shock peening surfaces on opposite sides respectively of an article with varying thickness using oppositely aimed laser beams, and varying surface pulse fluence of individual pulses of the laser beams over the laser shock peening surfaces as a function of the thickness of the article beneath each one of a plurality of laser shock peened spots formed by the beams on the surfaces.

2. A method as claimed in claim 1, further comprising keeping the fluence equal to the thickness multiplied by a volumetric fluence factor and holding the volumetric fluence factor constant over the laser shock peening surfaces.

3. A method as claimed in claim 2, further comprising the volumetric fluence factor being in a range of about 1200 J/cm$^3$ to 1800 J/cm$^3$.

4. A method as claimed in claim 2, further comprising the volumetric fluence factor being about 1500 J/cm$^3$.

5. A method as claimed in claim 2, further comprising the article being a gas turbine engine airfoil and the opposite sides being pressure and suction sides of the airfoil.

6. A method as claimed in claim 5, further comprising the article being a thin gas turbine engine rotor blade airfoil.

7. A method as claimed in claim 5, further comprising the article being a thin gas turbine engine compressor blade airfoil made of a Titanium alloy.

8. A method as claimed in claim 5, further comprising the article being a thin gas turbine engine compressor blade airfoil made of a Titanium alloy and having a maximum thickness of about 0.1 inches.

9. A method as claimed in claim 8, further comprising keeping the fluence equal to the thickness multiplied by a volumetric fluence factor and holding the volumetric fluence factor constant over the laser shock peening surface.

10. A method as claimed in claim 9, further comprising the volumetric fluence factor being in a range of about 1200 J/cm$^3$ to 1800 J/cm$^3$.

11. A method as claimed in claim 9, further comprising the volumetric fluence factor being about 1500 J/cm$^3$.

12. A method as claimed in claim 9, further comprising the varying of surface pulse fluence over the laser shock peening surface includes varying the surface pulse fluence individually for each of the laser shock peened spots.

13. A method as claimed in claim 12, further comprising the varying of surface pulse fluence individually includes varying laser beam energy of the laser beam individually for each of the laser shock peened spots.

14. A method as claimed in claim 9, further comprising the varying of surface pulse fluence over the laser shock peening surface includes varying the surface pulse fluence incrementally for groups of the laser shock peened spots.

15. A method as claimed in claim 14, further comprising the varying of surface pulse fluence incrementally includes varying laser beam energy of the laser beam for each of the groups of laser shock peened spots.

16. A laser shock peened article comprising:

a laser shock peening surface of an article with varying thickness and the laser shock peening surface having been laser shock peened by varying surface pulse fluence of individual pulses of a laser beam over the laser shock peening surface as a function of the thickness of the article beneath each one of a plurality of laser shock peened spots formed by the beam on the surface, compressive residual stresses imparted by the laser shock peening extending into the article from the laser shock peening surface, and the compressive residual stresses varying in depth and intensity over the laser shock peening surface as a function of the thickness of the article beneath each one of a plurality of laser shock peened spots formed by the beam on the surface.

17. An article as claimed in claim 16, further comprising the laser shock peening surface having been laser shock peened with the fluence kept equal to the thickness multiplied by a volumetric fluence factor and the volumetric fluence factor held constant over the laser shock peening surface.

18. An article as claimed in claim 17, further comprising the laser shock peening surface having been laser shock peened with the volumetric fluence factor in a range of about 1200 J/cm$^3$ to 1800 J/cm$^3$.

19. An article as claimed in claim 17, further comprising the laser shock peening surface having been laser shock peened with the volumetric fluence factor at about 1500 J/cm$^3$.

20. An article as claimed in claim 16, further comprising the article being a gas turbine engine airfoil.

21. An article as claimed in claim 20, further comprising the laser shock peening surface having been laser shock peened with the fluence kept equal to the thickness multiplied by a volumetric fluence factor and the volumetric fluence factor held constant over the laser shock peening surface.

22. An article as claimed in claim 21, further comprising the gas turbine engine airfoil being made of a Titanium alloy.

23. An article as claimed in claim 22, further comprising the gas turbine engine airfoil having a maximum thickness of about 0.1 inches.

24. An article as claimed in claim 23, further comprising the laser shock peening surface having been laser shock peened with the volumetric fluence factor in a range of about 1200 J/cm$^3$ to 1800 J/cm$^3$.

25. An article as claimed in claim 23, further comprising the laser shock peening surface having been laser shock peened with the volumetric fluence factor at about 1500 J/cm$^3$.

26. An article as claimed in claim 25, further comprising the gas turbine engine airfoil being in a compressor rotor blade.

27. A dual sided laser shock peened article comprising:

simultaneously laser shock peening opposite laser shock peening surfaces on opposite sides respectively of the article, a varying thickness between the opposite sides and the opposite laser shock peening surfaces, and the opposite laser shock peening surfaces having been laser shock peened by varying surface pulse fluence of individual pulses of oppositely aimed laser beams over the laser shock peening surfaces as a function of the thickness of the article beneath each one of a plurality of laser shock peened spots formed by the beams on the surfaces, compressive residual stresses imparted by the laser shock peening extending into the article from the laser shock peening surfaces, and the compressive residual stresses varying in depth and intensity over the laser shock peening surfaces as a function of the thickness of the article beneath each one of a plurality of laser shock peened spots formed by the beams on the surface.

28. An article as claimed in claim 27, further comprising the laser shock peening surfaces having been laser shock peened with the fluence kept equal to the thickness multiplied by a volumetric fluence factor and the volumetric fluence factor held constant over the laser shock peening surfaces.

29. An article as claimed in claim 28, further comprising the laser shock peening surfaces having been laser shock peened with the volumetric fluence factor in a range of about 1200 J/cm$^3$ to 1800 J/cm$^3$.

30. An article as claimed in claim 28, further comprising the laser shock peening surface having been laser shock peened with the volumetric fluence factor at about 1500 J/cm$^3$.

31. An article as claimed in claim 27, further comprising the article being a gas turbine engine airfoil.

32. An article as claimed in claim 31, further comprising the laser shock peening surfaces having been laser shock peened with the fluence kept equal to the thickness multiplied by a volumetric fluence factor and the volumetric fluence factor held constant over the laser shock peening surface.

33. An article as claimed in claim 32, further comprising the gas turbine engine airfoil being made of a Titanium alloy.

34. An article as claimed in claim 33, further comprising the gas turbine engine airfoil having a maximum thickness of about 0.1 inches.

35. An article as claimed in claim 34, further comprising the laser shock peening surfaces having been laser shock peened with the volumetric fluence factor in a range of about 1200 J/cm$^3$ to 1800 J/cm$^3$.

36. An article as claimed in claim 34, further comprising the laser shock peening surfaces having been laser shock peened with the volumetric fluence factor at about 1500 J/cm$^3$.

37. An article as claimed in claim 36, further comprising the gas turbine engine airfoil being in a compressor rotor blade.

* * * * *